US012331951B1

(12) United States Patent
Blincoe

(10) Patent No.: US 12,331,951 B1
(45) Date of Patent: Jun. 17, 2025

(54) RESIDENTIAL HVAC SAFETY CONTROL

(71) Applicant: Rodney Craig Blincoe, Highlands Ranch, CO (US)

(72) Inventor: Rodney Craig Blincoe, Highlands Ranch, CO (US)

( * ) Notice: Subject to any disclaimer, the term of this patent is extended or adjusted under 35 U.S.C. 154(b) by 0 days.

(21) Appl. No.: 19/091,868

(22) Filed: Mar. 27, 2025

(51) Int. Cl.
*F24F 11/88* (2018.01)
*F24F 11/33* (2018.01)
*F24F 11/52* (2018.01)
*F24F 11/56* (2018.01)

(52) U.S. Cl.
CPC ..... *F24F 11/88* (2018.01); *F24F 11/33* (2018.01); *F24F 11/52* (2018.01); *F24F 11/56* (2018.01)

(58) Field of Classification Search
CPC .. F24F 11/88; F24F 11/52; F24F 11/56; F24F 11/33
See application file for complete search history.

(56) References Cited

U.S. PATENT DOCUMENTS 9,605,858 B2 * 3/2017 Warren ..... G05D 23/1902
10,726,695 B1 7/2020 Blincoe
11,519,622 B2 12/2022 Blincoe
11,619,411 B2 4/2023 Blincoe
2012/0248210 A1 * 10/2012 Warren ..... F24F 11/52 236/1 C
2014/0262134 A1 * 9/2014 Arensmeier ..... F24D 5/12 165/11.2
2014/0316583 A1 * 10/2014 Ambriz ..... F24F 11/30 700/277
2018/0191154 A1 * 7/2018 Warren ..... H02H 7/20
2023/0332792 A1 * 10/2023 Chapman ..... G05B 19/042
2024/0263820 A1 * 8/2024 Amer ..... F24F 11/49

* cited by examiner

*Primary Examiner* — Mohammad Ali
*Assistant Examiner* — Vincent W Chang
(74) *Attorney, Agent, or Firm* — Roger A. Jackson

(57) ABSTRACT

A residential HVAC safety control to effectuate a timely manually selectable portable and remote wireless shutdown of an existing residential HVAC system, the existing residential HVAC system receives electrical power from an electrical utility with alternating current having a neutral wire leg and a hot wire leg, the residential HVAC safety control includes a power supply, a radio frequency receiver, and control circuitry that monitors for a first event marker signal results in the control circuitry outputting a second event marker to a switching transistor that activates a normally closed electrical relay to an open state, resulting in the existing residential HVAC system being deactivated as a result of a portable radio frequency transmitter that is operative to manually selectably transmit the wireless first event marker signal.

5 Claims, 8 Drawing Sheets

RESIDENTIAL HVAC SAFETY CONTROL

CROSS-REFERENCE TO RELATED APPLICATIONS

There are no related applications.

BACKGROUND OF INVENTION

The present invention relates generally to a system for sending electrical signals. More specifically, the present invention relates to the field of residential building fire safety and control of residential building systems in the event of a residential building fire.

Commercial buildings have long had additional fire safety procedures, inspections, and systems that residential buildings (housing) have typically not had, such as auto fire department calling when a fire detectors go off or when the building fire sprinkler system starting flowing, or when an exit door is opened. Further, commercial buildings can have Heating Ventilation and Air Conditioning (HVAC) systems automatically shutdown in the event of a fire to prevent spreading of toxic smoke, feeding the fire extra oxygen, or excessive cooling by the air conditioning system. Also, commercial systems have items like battery powered lighted EXIT signs in the event of electrical failure and smoke present and same goes for emergency stairway and hall lighting, in addition to automatic closing of fire doors for fire suppression, automatic elevator height level defaults for fireman to use, auto ventilation systems for removing smoke, and the like.

However, for residential buildings, fire safety has been minimal or at a much lower level, which is curious as people sleep at home, while they are awake at commercial buildings, i.e. while at work. So, in a sense, people are at more risk for fire danger at home while sleeping. It is interesting that building fire codes are typically much more strict for commercial buildings (where occupants are typically awake and alert) verses residential buildings (where occupants sleep and have higher risks for smoking, candles, fireplaces, and the like that typically don't exist in commercial buildings). Because of this there is a definite need for commercial type fire safety protection for residential buildings to enhance the safety of people in their homes, i.e. with a focus on automated systems that activate home building systems to enhance fire safety even while the home occupants are sleeping. There has been some activity in this area with KIDDE fire detectors that have wireless communication to one another, i.e. such that if there are multiple fire detectors within a single house and that if a single fire detector activates, then all the fire detectors alarm for notifying a house occupant that is located in the house in a remote area from the location of the original fire detection.

In looking at the prior art in the residential building digital transmission and data switching arts in U.S. Pat. No. 9,286,781 to Filson et al., discloses a smart home system that is assigned to Google that teaches digital interconnection between components that includes a thermostat, a fire detector, and cameras, using sensors that include smoke, audio, acceleration, seismic, temperature, humidity, and radiation, with all sensors communicating to an event processor that further analyzes the combination of sensor inputs to help ascertain whether an earthquake, tornado, power outage, or weather event has likely occurred, thus this system is primarily for notification purposes rather than any automated equipment change of operational state being effectuated.

Further in the above prior art area in U.S. Pat. No. 6,891,838 to Petite et al., disclosed is a monitoring and controlling system for residential buildings that includes a sensor that outputs a sensor data signal, a processor to format the sensor data signal for a particular function to evaluate the parameter for the sensor, and to create a follow on signal based on selected parameter values.

Continuing in the above prior art area in U.S. Pat. No. 10,403,127 to Sloo et al., disclosed is a smart home device that is assigned to Google wherein the smart home device provides follow up communications for detection events; the device includes a sensor that detects a dangerous condition in a home environment, a processor that determines a first state of moderate danger and then an second state then having the ability to determine whether the danger has ceased based on the first and second states. Again, this is a notification type system rather than an automated equipment change of operational state in reaction to sensor outputs.

Next in the above prior art area in U.S. Pat. No. 10,331,095 to Patel et al., discloses a method and system for an automation control device that includes a processor that is configured in response to receive an input message, map the message to a control message, and to determine a control action for the automation control asset.

Continuing in the above prior art area in U.S. Pat. No. 10,282,787 to Hakimi-Boushehri et al., disclosed is a system for determining a loss to a property that is assigned to State Farm Insurance, wherein the system includes a smart home controller that monitors a sensor that has data stored a baseline level of data, wherein when the sensor provides data outside of the baseline the controller will determine damage to the property based on the sensor input, and engaging in automated insurance company form submittal.

Moving onward in the above prior art area in U.S. Pat. No. 10,158,498 to Brandman et al., discloses a building sensor monitoring and control system that is assigned to the Hartford Fire Insurance Company, wherein the system includes multiple sensors that generate electronic signals that are evaluated for a risk situation, wherein signals with unique instructions are generated to try to mitigate the situation at the electromechanical device and if the conditions are not mitigated the system changes control parameters.

Further in the above prior art area in U.S. Pat. No. 10,361,878 to Loreille, discloses a system for initiating actions automatically on home smart devices that starts with a movement sensor action trigger signal that causes an action to initiate video recording and record a log.

Continuing in the prior art in U.S. Pat. No. 10,726,695 to Blincoe, disclosed is a building safety system that receives a first communication from a fire sensing appliance and translates the first communication to a building system to effectuate a selected response from the building system. The building safety system in Blincoe includes control circuitry in a ready state that is operative to monitor the first communication and to produce a first event market signal upon receipt of the first communication, the first event market signal is in a first electrical communication with the building system, wherein operationally the first event marker signal effectuates the selected response from the building system.

Next in the prior art in U.S. Pat. No. 11,519,622 to Blincoe, disclosed is an HVAC monitoring system utilizing an in-duct sensor to detect a gas abnormal condition with a first event marker signal generated from the sensor, wherein also included is a fuse module that replaces the existing HVAC system circuit board power feed fuse wherein the fuse module includes control circuitry to monitor the first event marker signal and output a second event market signal to a normally closed relay that when activated by the second event marker signal opens the relay to shut down the existing HVAC system.

Further in the prior art in U.S. Pat. No. 11,619,411 to Blincoe, disclosed is an HVAC monitoring system utilizing a sensor to detect a gas abnormal condition with a first event marker signal generated from the sensor, wherein also included is an audio sensor, a wireless transmitter, a wireless receiver, programmable control circuitry, a switching transistor, a relay, and a power supply, wherein these components utilize the first event marker signal through a series of subsequent signals to result in the relay being operative to be activated to effectuate the selected response from the HVAC building system.

What is needed is a HVAC monitoring system that is positioned to fill a void in residential building fire protection being the failure to shut off the central ventilation system blower (HVAC) in the case of fire. In the event of a residential house fire when the HVAC unit is activated, the air blower (air conditioning) ramps up to compensate for the heat which further feeds the fire with oxygen from the air and spreads toxic gasses and smoke throughout the house further making the fire worse.

Currently in the prior art the vast majority of installed residential building fire alarm systems alert the user with a high-audible volume alarm appliance to allow the occupants to escape safely but do nothing to reduce the severity of the fire. The present invention is desirably easy to install and inexpensive that adds a layer of protection to residential buildings to help save lives and to help reduce property loss.

SUMMARY OF THE INVENTION

Broadly, the present invention is the residential HVAC safety control to effectuate a timely manually selectable portable and remote wireless shutdown of an existing residential HVAC system, the existing residential HVAC system receives electrical power from an electrical utility with alternating current having a neutral wire leg and a hot wire leg, the residential HVAC safety control includes a power supply that is in an input first electrical communication with a first input electrical power, wherein the power supply further includes a full wave bridge rectifier circuit with a wave smoothing capacitor and resistor for more consistent voltage and a first electrical buck convertor transformer resulting in a first electrical power output that converts the utility alternating current voltage to a first reduced voltage direct current, further a second electrical buck convertor transformer results in a second electrical power output that converts the utility alternating current voltage to a second reduced voltage direct current.

The residential HVAC safety control further includes a radio frequency receiver that receives the second electrical power output from the power supply, also included is control circuitry that receives input electrical power from the second reduced voltage direct current through a second electrical communication, the control circuitry is in a ready state being operative to monitor for a wireless first event marker signal along a seventh electrical communication results in the control circuitry outputting a second event marker signal along a third electrical communication. Additionally included in the residential HVAC safety control is a switching transistor having a base connection, a collector connection, and an emitter connection, the base connection and is operative to receive the second event marker signal and when the second event marker signal is received results in the collector connection and the emitter connection being placed from a switched transistor open electrical communication state to a switching transistor closed electrical communication state to facilitate electrical communication from the collector connection to the emitter connection.

The residential HVAC safety control also includes a normally closed electrical relay that receives input electrical power from the first reduced voltage direct current being a positive leg only to a primary terminal of the normally closed electrical relay, the normally closed electrical relay is also in electrical communication to the switching transistor collector connection through a secondary terminal on the normally closed electrical relay, the normally closed electrical relay switched leg is disposed in a fourth electrical communication as between the electrical power from the electrical utility hot wire leg defined as going from an input connection to an output connection of the fourth electrical communication. The electrical relay as a normally closed electrical relay hot wire input connection and the existing residential HVAC system through a switched hot wire leg defined as a normally closed electrical relay hot wire output connection that receives the switched hot wire leg electrical power from the electrical utility, resulting in operationally the normally closed electrical relay allowing the fourth electrical communication from the input to the output connections being the electrical utility hot wire leg electrical power to the existing residential HVAC system, with the electrical utility neutral leg being in a fifth electrical communication as between the electrical utility and the neutral leg power feed of the existing residential HVAC system.

For the residential HVAC safety control this results in the existing residential HVAC system being in a fully functional operational state when the normally closed electrical relay is in an un-activated operational state such that the normally closed electrical relay is in a closed state, and when the normally closed electrical relay is in an activated operational open state, opens the fourth electrical communication from the hot leg from the electrical utility to the electrical utility hot wire leg electrical power feed to the existing residential HVAC system. The normally closed electrical relay is energized into the activated operational open state through a negative ground of the first reduced voltage direct current being in a sixth electrical communication therethrough the collector connection to the emitter connection, resulting in the normally closed electrical relay switched leg moving to an open operational state resulting in the existing residential HVAC system being deactivated.

For the residential HVAC safety control also included is a portable radio frequency transmitter that receives input electrical power from a battery, the portable radio frequency transmitter is operative to manually selectably wirelessly originally transmit the wireless first event marker signal that is received by the radio frequency receiver and the control circuitry that in turn generates the second event marker signal, the radio frequency receiver control circuitry terminates the second event marker signal after the portable radio frequency transmitter manually transmits the wireless first event marker signal by a time period of approximately thirty (30) minutes that results in the open electrical relay switched leg moving to the normally closed electrical relay operational state resulting in the existing residential HVAC system being reactivated operationally as a reset for the residential HVAC safety control.

These and other objects of the present invention will become more readily appreciated and understood from a consideration of the following detailed description of the exemplary embodiments of the present invention when taken together with the accompanying drawings, in which;

DETAILED DESCRIPTION OF THE INVENTION

Figure 1:
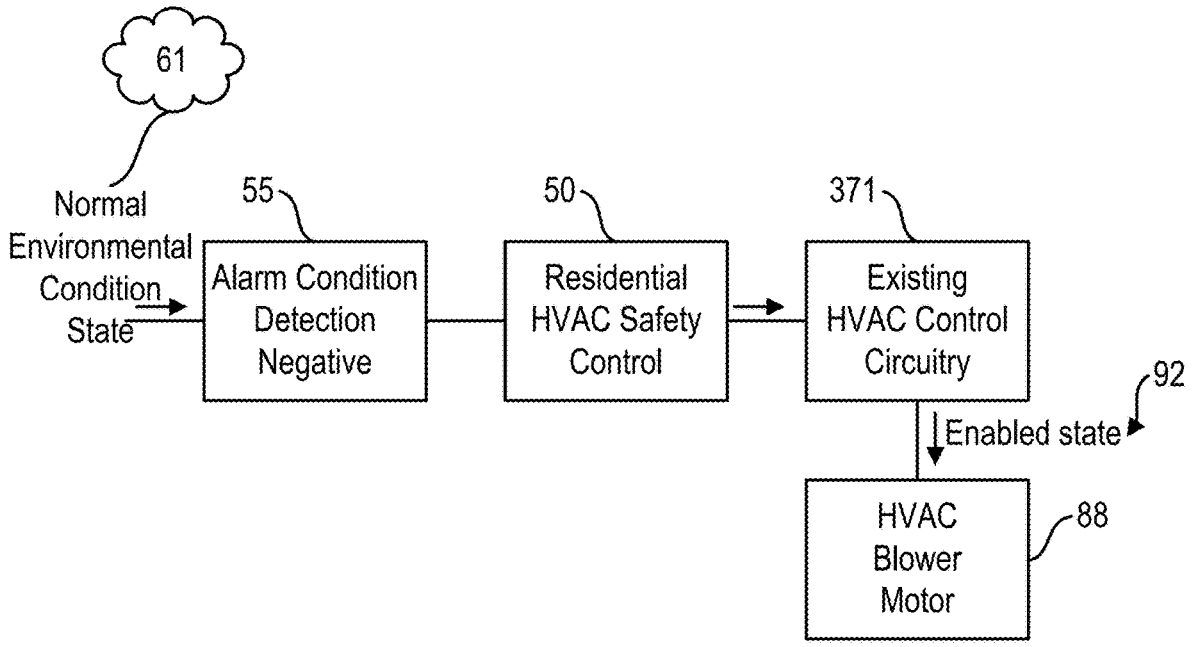
FIG. 1 shows a summary schematic diagram of the residential HVAC safety control in the normal environmental condition operational state with the HVAC blower motor in the normal enabled operational state.

50 Residential HVAC Safety Control
51 User
55 Timely manually selectable portable and remote wireless shutdown by the user 51
60 Abnormal environmental state
61 Normal environmental state
65 Existing residential HVAC system that typically includes the return duct 70, the exit duct 75, the thermostat 80, the fan 85, the heating element 90, and the cooling element 95, the fan 85, and the fan motor 88, and the HVAC control circuit board 371
70 Return duct of the existing HVAC system 65
75 Exit duct of the existing HVAC system 65
76 Enclosure of the fan 85 and fan motor 88
80 Thermostat of the HVAC building system 65
85 Fan of the existing HVAC system 65
87 Filter of the fan 85
88 Motor of the HVAC blower fan 85
90 Heating element of the existing residential HVAC system 65
91 Disabled or deactivated state of the existing residential HVAC system 65
92 Enabled or activated state of the existing residential HVAC system 65

95 Cooling element of the existing residential HVAC system 65
105 Selected response from of the existing residential HVAC system 65 typically being the deactivation/disabled state 91 of the residential HVAC system 65
106 Hot wire of the 110 VAC utility electrical power feed to the existing residential HVAC system 65
108 Neutral wire of the 110 VAC utility electrical power feed through the fifth electrical communication 110 to the existing residential HVAC system 65
109 Hot wire of the 110 VAC connection directly downstream of the electrical relay 225 to the existing residential HVAC system 65 110 Fifth electrical communication
140 Fire
165 Residential building
166 Interior of the residential building 165
167 Exterior of the residential building 165
170 Existing residential HVAC system 65 air outlet or outlet air movement
175 Existing residential HVAC system 65 air inlet or inlet air movement
180 Radio frequency receiver
185 First input electrical power
190 Power supply
195 Input first electrical communication
200 Full wave bridge rectifier diodes D1, D2, D3, D4 that are preferably MXUTEUK electronic silicon diodes model M-021
205 Wave smoothing capacitor preferably rated at 470 micro-Farads
210 Wave smoothing resistor for voltage control preferably rated at 10K ohms
215 First electrical buck converter transformer
220 First electrical power output
221 First reduced voltage direct current
225 Electrical relay that is in the normally closed operational state that is preferably a UXCELL model A14060500ux1280
226 Activated operational state of the relay 225 in the open operational state resulting in the disabled state 91 of the existing residential HVAC system 65
227 Un-activated operational state of the relay 225 in the normally closed operational state resulting in the enabled state 92 of the existing residential HVAC system 228 Primary terminal of the relay 225
229 Secondary terminal of the relay 225
230 Second electrical buck converter transformer
235 Second electrical power output
240 Second reduced voltage direct current
245 Control circuitry
250 Input electrical power for the control circuitry 245
255 Second electrical communication
260 Wireless first event marker signal
371 Existing residential HVAC system 65 control circuitry board of the existing HVAC system 65
372 Existing residential HVAC control circuitry 371 electrical neutral leg power feed, typically 110 VAC, connector from the building utility electrical power
377 Relay 225 input connection to the 106 utility electrical Hot wire of the 110 VAC utility electrical power 830 previous feed to the existing HVAC system 65
381 Relay 225 output connection to the Hot wire of the 110 VAC feed of the existing residential HVAC system 65 735 Electrical resister R1 preferably about 2.2K ohms for current limiting
745 Sixth electrical communication from the first electrical power output 220 being about 24 VDC to the relay 225 that is in the normally closed operational state 227
750 Switching transistor being preferably a CENTRAL SEMICONDUCTOR CORPORATION model TIP 120
751 Switching transistor 750 collector to emitter open electrical communication state
752 Switching transistor 750 collector to emitter closed electrical communication state
755 Diode is preferably a SMC DIODE SOLUTIONS model 1N4004
756 Fourth electrical communication
760 Second event marker signal from the control circuitry 245 in operational state being the environmental abnormal condition 55, 60 to switching transistor 750 "base" leg
761 Third electrical communication
785 Wireless first event marker signal 260 from the radio frequency receiver 180 to the control circuitry 245
786 Seventh electrical communication of the wireless first event marker signal 260
787 Input connection of the fourth electrical communication 756 of the electrical relay 225
788 Output connection of the fourth electrical communication 756 of the electrical relay 225
805 Portable radio frequency transmitter manually activated by the user 51
810 Battery electrical power for the portable radio frequency transmitter 805
815 Means for manually selectably initiating the first event marker signal 260 from the portable radio frequency transmitter 805
820 Means 815 in the form of a covered button assembly
825 LED status light of the radio frequency receiver 180
830 LED status light of the portable radio frequency transmitter 805
835 Pivotal hinge of the button 820 as between the cover 840 and the button housing
840 Cover of the button assembly 820
845 Push button of the button assembly 820
850 Housing of the button assembly 820
855 Pivotal movement of the cover 840

With initial reference to FIG. 1 shown is a summary schematic diagram of the residential HVAC safety control 50 in the normal environmental condition operational state 61 with the HVAC blower motor 88 in the normal enabled operational state 92.

Figure 2:
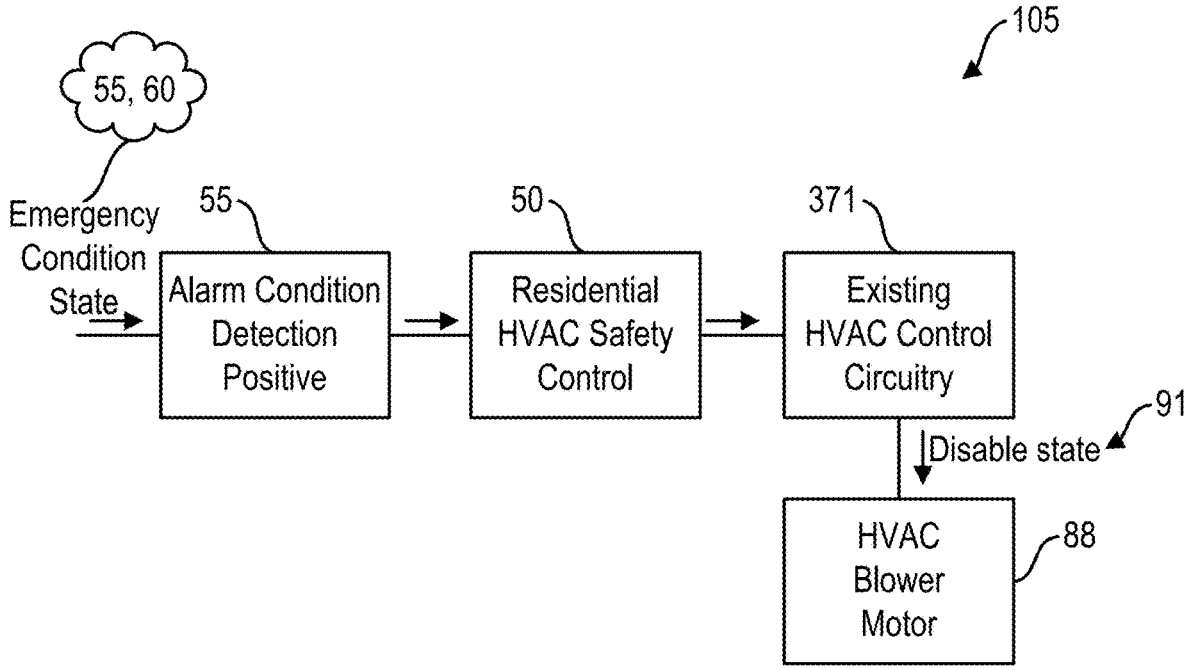
FIG. 2 shows a summary schematic diagram of the residential HVAC safety control in the emergency environmental condition state with the HVAC blower motor in the disabled operational state.

Next, FIG. 2 shows a summary schematic diagram of the residential HVAC safety control 50 in the emergency environmental condition state 60 with the HVAC blower motor 88 in the disabled operational state 91.

Figure 3:
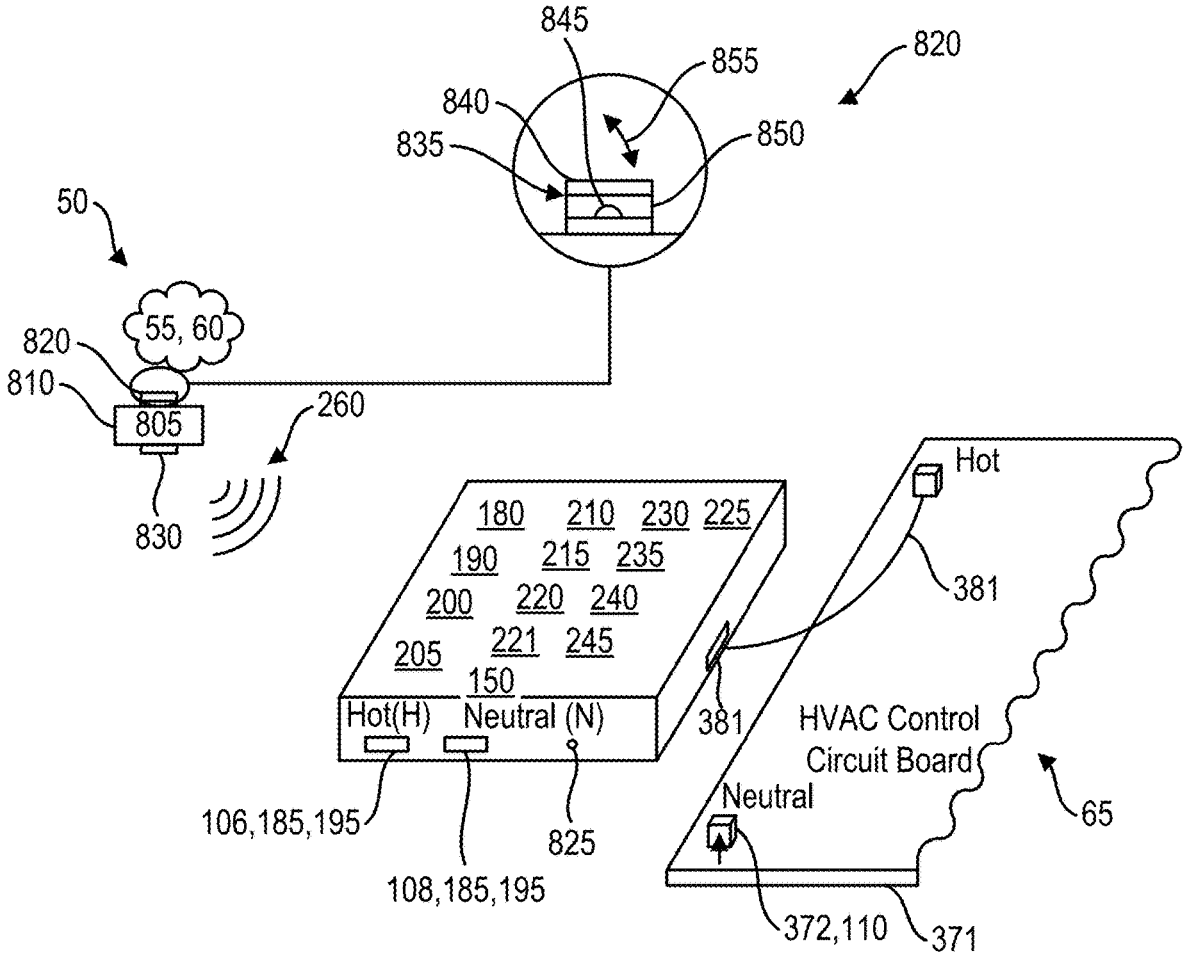
FIG. 3 shows a component/element perspective functional view of the residential HVAC safety control as a module with the interfaces to an existing residential HVAC system, an existing neutral leg connection on an existing HVAC control circuit board, and further a portable radio frequency transmitter creates a wireless first event marker signal to the radio frequency receiver.

Further, FIG. 3 shows a component/element perspective functional view of the residential HVAC safety control 50 as a module with the interfaces to an existing residential HVAC system 65, an existing neutral leg 108 connection on an existing HVAC control circuit board 371, and further a portable radio frequency transmitter 805 creates a wireless first event marker signal 260 to the radio frequency receiver 180.

Figure 4:
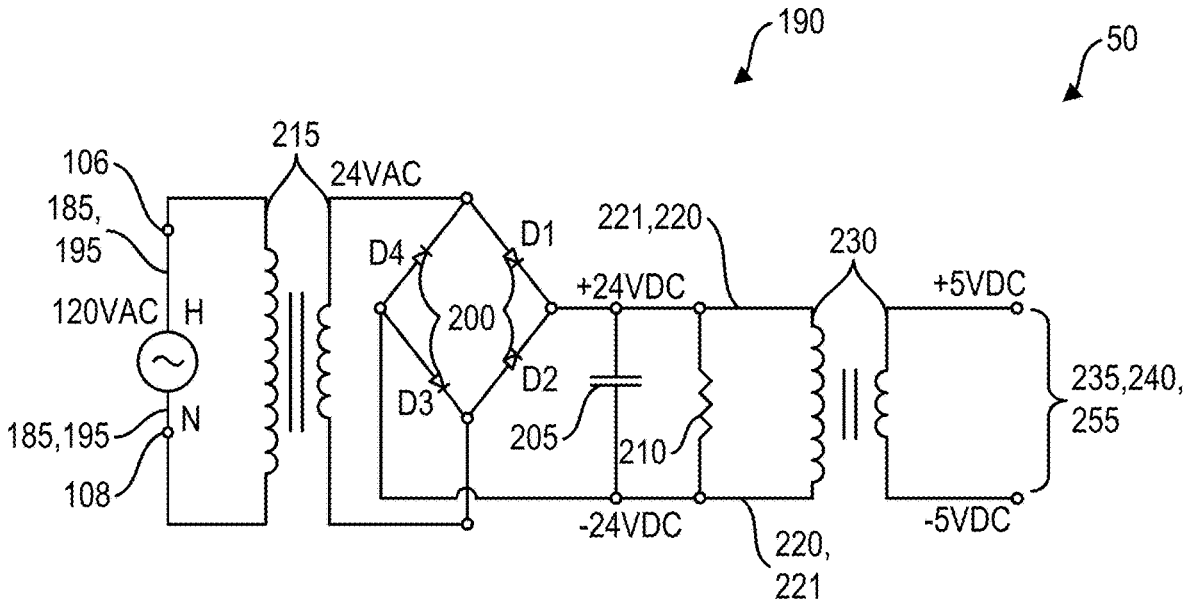
FIG. 4 shows an electrical schematic of a power supply circuitry of the residential HVAC safety control that includes an existing 120 VAC electrical utility power supply that is in electrical communication with a first buck converter transformer that is in electrical communication with a full wave bridge rectifier that is in electrical communication with a smoothing capacitor and a voltage control resistor providing electrical power to a second buck converter transformer.

Continuing, FIG. 4 shows an electrical schematic of a power supply circuitry 190 of the residential HVAC safety control 50 that includes an existing 120 VAC electrical utility power supply 106, 108 that is in electrical communication with a first buck converter transformer 215 that is in electrical communication with a full wave bridge rectifier 200 that is in electrical communication with a smoothing capacitor 205 and a voltage control resistor 210 providing electrical power to a second buck converter transformer 230.

Figure 5:
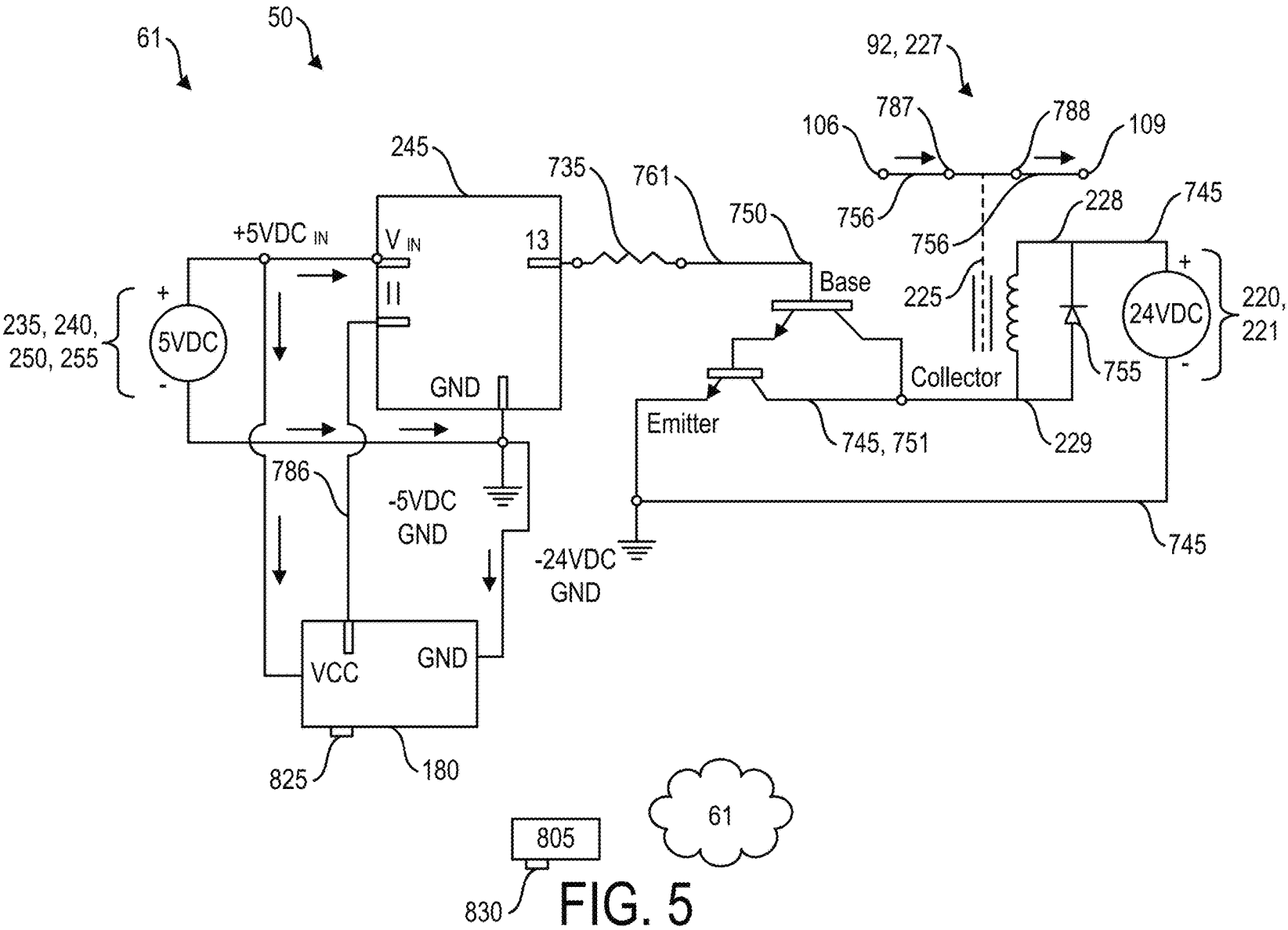
FIG. 5 shows an electrical schematic of the residential HVAC safety control in the normal environmental condition state with the relay in the closed position state facilitating the activated enabled state of the existing residential HVAC system with the power supply electrical schematic not shown for clarity (as the power supply electrical schematic is detailed in FIG. 4). Thus shown in FIG. 5 in a summary manner, the wireless first event marker signal is not shown from the portable radio frequency transmitter (as the existing portable radio frequency transmitter is not manually activated by the user) the portable radio frequency transmitter that is in wireless communication (again this wireless communication is not shown due to no user manual activation) with a radio frequency receiver that is a seventh electrical communication with control circuitry that in turn is in a third electrical communication with a switching transistor with the control circuitry not showing a second event marker signal output to the switching transistor, wherein in the user having no manual activation of the portable radio frequency transmitter with the switching transistor is in an open operational state, thus resulting in the relay being de-energized remaining in the normally closed operational state with the existing residential HVAC system in the normal enabled operational state.

Moving onward, FIG. 5 shows an electrical schematic of the residential HVAC safety control 50 in the normal environmental condition state 61 with the relay 225 in the closed position state 227 facilitating the activated enabled state 92 of the existing residential HVAC system 65 with the power supply electrical schematic 190 not shown for clarity (as the power supply electrical schematic 190 is detailed in FIG. 4). Thus shown in FIG. 5 in a summary manner, the wireless first event marker signal 260 is not shown from the portable radio frequency transmitter 805 (as the existing portable radio frequency transmitter 805 is not manually activated by the user) the portable radio frequency transmitter 805 that is in wireless communication (again this wireless communication is not shown due to no user manual activation) with a radio frequency receiver 180 that is a seventh electrical communication 786 with control circuitry 245 that in turn is in a third electrical communication 761 with a switching transistor 750 with the control circuitry 245 not showing a second event marker signal output 760 to the switching transistor 750. Wherein in the user having no manual activation of the portable radio frequency transmitter 805 with the switching transistor 750 being in an open operational state 751, thus resulting in the relay 225 being de-energized remaining in the normally closed operational state 227 with the existing residential HVAC system 65 in the normal enabled operational state 92.

Figure 6:
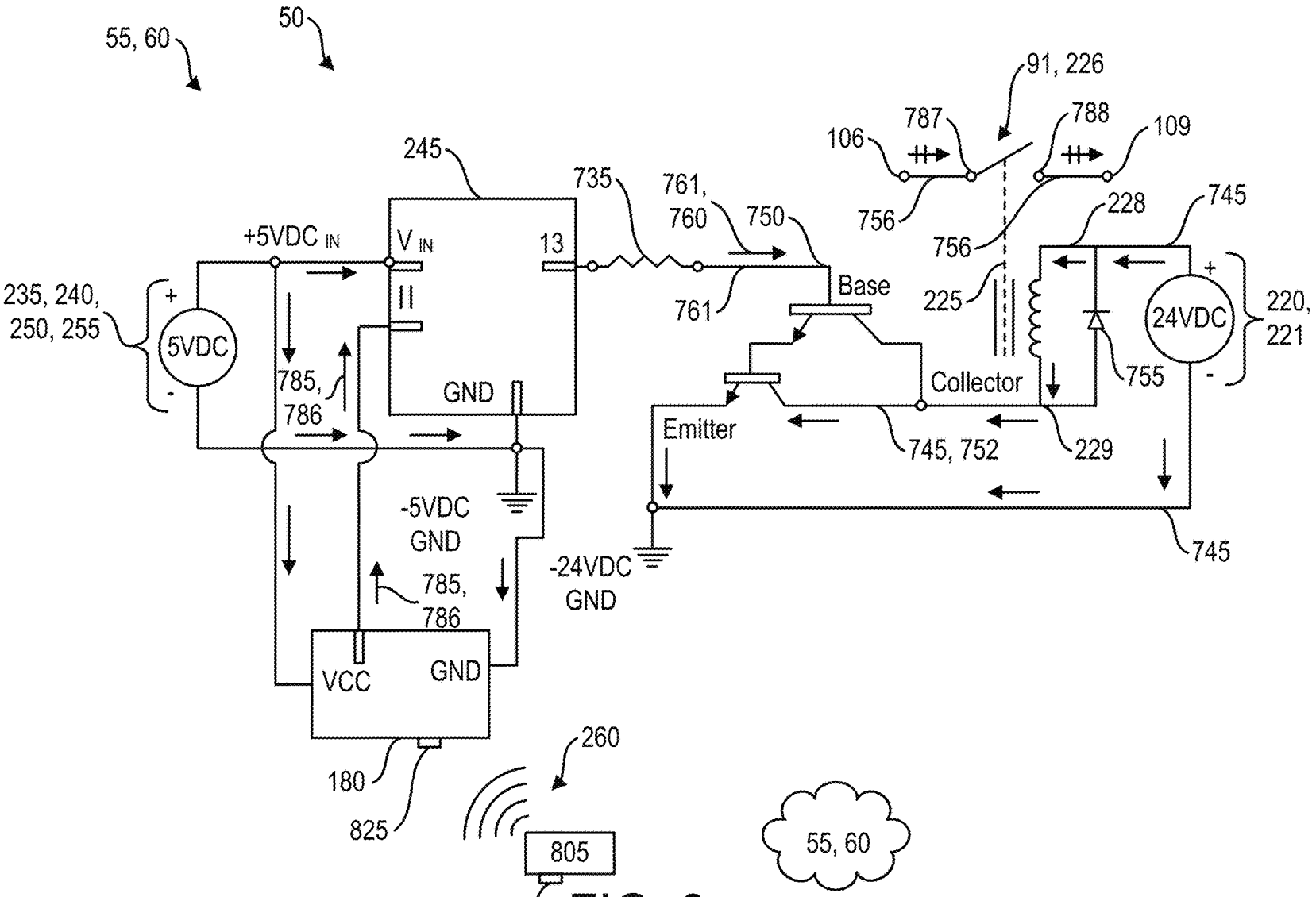
FIG. 6 shows an electrical schematic of the residential HVAC safety control in the abnormal environmental condition state with the relay in the open position state facilitating the disabled state of the existing residential HVAC system with the power supply electrical schematic not shown for clarity (as the power supply electrical schematic is detailed in FIG. 4). Thus shown in FIG. 6 in a summary manner, the wireless first event marker signal is shown from the portable radio frequency transmitter (as the existing portable radio frequency transmitter is manually activated by the user) the portable radio frequency transmitter that is in wireless communication being the first event market signal (again this wireless communication being the first event marker signal is shown due to user manual activation) with the radio frequency receiver outputting the first event marker signal that is a seventh electrical communication with control circuitry that in turn is in a third electrical communication with the switching transistor outputting a second event marker signal to the switching transistor, wherein in the user having manual activation of the portable radio frequency transmitter with the switching transistor being placed in a closed operational state, thus resulting in the relay being energized going toward the open operational state resulting in the existing residential HVAC system being placed in the deactivated operational state.

Further, FIG. 6 shows an electrical schematic of the residential HVAC safety control 50 in the abnormal environmental condition state 60 with the relay 225 in the open position state 226 facilitating the disabled state 91 of the existing residential HVAC system 65 with the power supply electrical schematic 190 not shown for clarity (as the power supply electrical schematic 190 is detailed in FIG. 4). Thus shown in FIG. 6 in a summary manner, the wireless first event marker signal 260 is shown from the portable radio frequency transmitter 805 (as the existing portable radio frequency transmitter 805 is manually activated by the user) the portable radio frequency transmitter 805 that is in wireless communication being the first event market signal 260 (again this wireless communication being the first event marker signal 260 is shown due to user manual activation) with the radio frequency receiver 180 outputting the first event marker signal 260 that is a seventh electrical communication 786 with control circuitry 245 that in turn is in a third electrical communication 761 with the switching transistor 750 outputting a second event marker signal 760 to the switching transistor 750, wherein in the user having manual activation of the portable radio frequency transmitter 805 with the switching transistor 750 being placed in a closed operational state 752, thus resulting in the relay 225 being energized going toward the open operational state 226 resulting in the existing residential HVAC system 65 being placed in the deactivated operational state 91.

Figure 7:
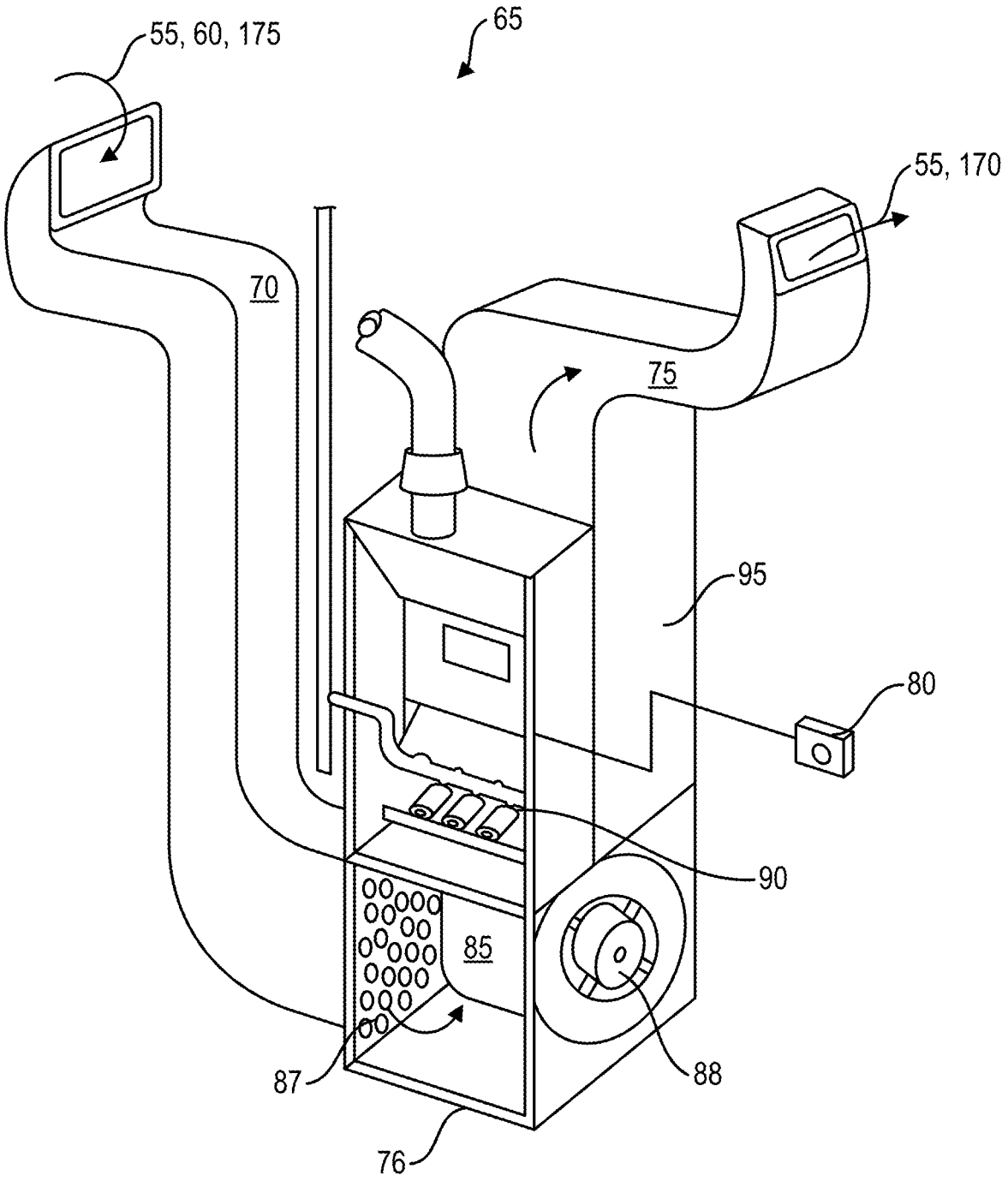
FIG. 7 shows an upper perspective view of a complete existing residential HVAC system that includes a return duct, an exit duct, a thermostat, a heating element, a cooling element, a fan, and a fan motor.

Next, FIG. 7 shows an upper perspective view of a complete existing residential HVAC system 65 that includes a return duct 70, an exit duct 75, a thermostat 80, a heating element 90, a cooling element 95, a fan 85, and a fan motor 88.

Figure 8:
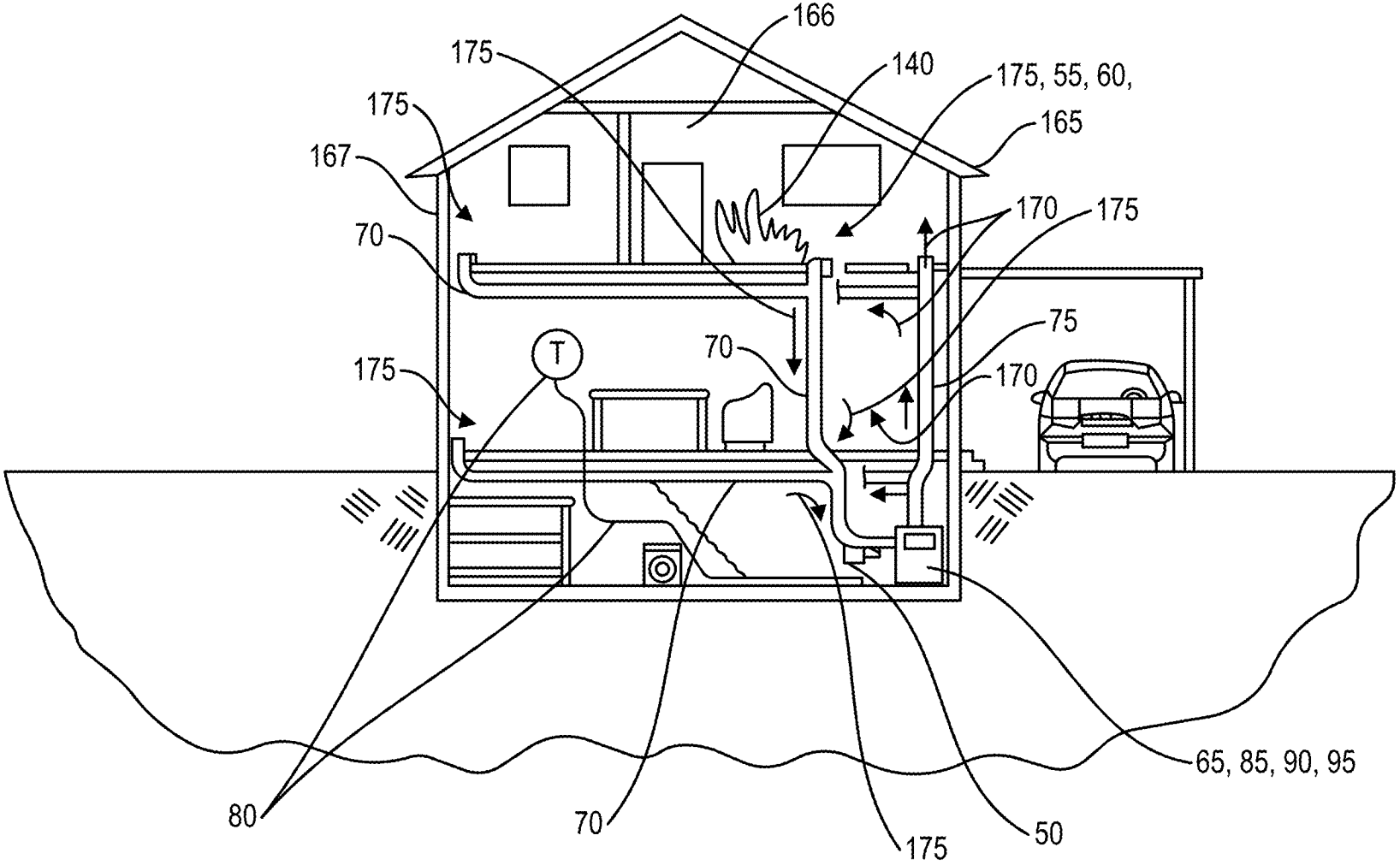
FIG. 8 shows a side elevation cross section of a use and installed drawing of the residential HVAC safety control, wherein the building is a typical residential structure with a basement, main floor, and a second story. Further, in FIG. 8 the residential structure shows the existing residential HVAC system in the form of a typical heating ventilation and cooling system (HVAC) in the basement with HVAC floor by floor air outlets shown and HVAC floor by floor air inlets shown throughout the residential structure as is also typical. Further shown in FIG. 8 are the return and exit ducts, wherein operationally if a fire occurs as shown on the second floor, the user can manually activate the portable radio frequency transmitter and generate a wireless first event marker signal to the radio frequency receiver that transmits through a seventh electrical communication the first event marker signal to the control circuitry that through a third electrical communication the control circuitry generates a second event marker signal to the switching transistor that closes the switching transistor from being open, wherein the closed switching transistor activates the relay from the normally closed state to the open state thus resulting in deactivating the existing residential HVAC system to stop the circulation of air at the return duct inlets and exit duct outlets to help prevent feeding the fire oxygen, also to stop the existing residential HVAC system from trying to cool the residential structure, and to help prevent the circulation of toxic smoke throughout the residential structure to lessen the negative effects of the fire.

Continuing, FIG. 8 shows a side elevation cross section of a use and installed drawing of the residential HVAC safety control 50, wherein the building is a typical residential structure 165 with a basement, main floor, and a second story. Further, in FIG. 8 the residential structure 165 shows the existing residential HVAC system 65 in the form of a typical heating ventilation and cooling system (HVAC) in the basement with HVAC floor by floor air outlets 170 shown and HVAC floor by floor air inlets 175 shown throughout the residential structure 165 as is also typical. Further shown in FIG. 8 are the return 70 and exit 75 ducts, wherein operationally if a fire 140 occurs as shown on the second floor, the user can manually activate the portable radio frequency transmitter 805 and generate the wireless first event marker signal 260 to the radio frequency receiver 180 that transmits through the seventh electrical communication 786 the first event marker signal 260 to the control circuitry 245 that through the third electrical communication 761 the control circuitry 245 generates a second event marker signal 760 to the switching transistor 750 that closes 752 the switching transistor 750 from being open 751, wherein the closed 752 switching transistor 750 activates the relay 225 from the normally closed state 227 to the open state 226 thus resulting in deactivating 91 the existing residential HVAC system 65 to stop the circulation of air at the return duct 70 inlets 175 and exit duct 75 outlets 170 to help prevent feeding the fire 140 oxygen, also to stop the existing residential HVAC system 65 from trying to cool 95 the residential structure 165, and to help prevent the circulation of toxic smoke throughout the residential structure 165 to lessen the negative effects of the fire 140.

Broadly, in looking at FIGS. 1 to 8, the present invention is the residential HVAC safety control 50 to effectuate a timely manually selectable portable and remote wireless shutdown 91 of an existing residential HVAC system 65, the existing residential HVAC system 65 receives electrical power from an electrical utility 106, 108 with alternating current having a neutral wire leg 108 and a hot wire leg 106, the residential HVAC safety control 50 includes a power supply 190 that is in an input first electrical communication 195 with a first input electrical power 185, wherein the power supply 190 further includes a full wave bridge rectifier circuit 200 with a wave smoothing capacitor 205 and resistor 210 for more consistent voltage and a first electrical buck convertor transformer 215 resulting in a first electrical power output 220 that converts the utility alternating current voltage 106, 108 to a first reduced voltage direct current 221, further a second electrical buck convertor transformer 230 results in a second electrical power output 235 that converts the utility alternating current voltage 106, 108 to a second reduced voltage direct current 240, see FIG. 4 in particular.

The residential HVAC safety control further includes a radio frequency receiver 180 that receives the second electrical power output 235 from the power supply 190, also included is control circuitry 245 that receives input electrical power from the second reduced voltage direct current 240 through a second electrical communication 255, the control circuitry 245 is in a ready state being operative to monitor for a wireless first event marker signal 260 along a seventh electrical communication 786 results in the control circuitry 245 outputting a second event marker signal 760 along a third electrical communication 761. Additionally included in the residential HVAC safety control 50 is a switching transistor 750 having a base connection, a collector connection, and an emitter connection, the base connection and is operative to receive the second event marker signal 760 and when the second event marker signal 760 is received results in the collector connection and the emitter connection being placed from a switched transistor 750 open electrical communication state 751 to a switching transistor 750 closed electrical communication state 752 to facilitate electrical communication from the collector connection to the emitter connection, see in particular FIGS. 5 and 6.

The residential HVAC safety control 50 also includes a normally closed electrical relay 225 that receives input electrical power from the first reduced voltage direct current 221 being a positive leg only to a primary terminal of the normally closed 227 electrical relay 225, the normally closed 227 electrical relay 225 is also in electrical communication to the switching transistor 750 collector connection through a secondary terminal on the normally closed 227 electrical relay 225, the normally closed 227 electrical relay 225 switched leg is disposed in a fourth electrical communication 756 as between the electrical power from the electrical utility hot wire leg 106 defined as going from an input connection 106 to an output connection 109 of the fourth electrical communication 756. The electrical relay 225 as a normally closed 227 electrical relay 225 hot wire input connection 106 and the existing residential HVAC system 65 through a switched hot wire leg 106 defined as a normally closed 227 electrical relay 225 hot wire output connection 109 that receives the switched hot wire leg electrical power 106 from the electrical utility, resulting in operationally the normally closed 227 electrical relay 225 allowing the fourth electrical communication 756 from the input 106 to the output 109 connections being the electrical utility hot wire leg electrical power 106 to the existing residential HVAC system 65, with the electrical utility neutral leg 108 being in a fifth electrical communication 110 as between the electrical utility and the neutral leg power feed 108 of the existing residential HVAC system 65, see FIGS. 1 to 8.

For the residential HVAC safety control 50 this results in the existing residential HVAC system 65 being in a fully functional operational state 92 when the normally closed 227 electrical relay 225 is in an un-activated operational state 227 such that the normally closed 227 electrical relay 225 is in a closed state 227, and when the normally closed 227 electrical relay 225 is in an activated operational open state 226, opens the fourth electrical communication 756 from the hot leg 106 from the electrical utility to the electrical utility hot wire leg electrical power feed 109 to the existing residential HVAC system 65. The normally closed 227 electrical relay 225 is energized into the activated operational open state 226 through a negative ground of the first reduced voltage direct current 221 being in a sixth electrical communication 745 therethrough the collector connection to the emitter connection of the switching transistor 750, resulting in the normally closed 227 electrical relay 225 switched leg moving to an open operational state 226 resulting in the existing residential HVAC system 65 being deactivated 91, see in particular FIGS. 4, 5, and 6.

For the residential HVAC safety control 50 also included is a portable radio frequency transmitter 805 that receives input electrical power from a battery 810, the portable radio frequency transmitter 805 is operative to manually selectably wirelessly originally transmit the wireless first event marker signal 260 that is received by the radio frequency receiver 180 and the control circuitry 245 that in turn generates the second event marker signal 760, the radio frequency receiver control circuitry 245 terminates the second event marker signal 760 after the portable radio frequency transmitter 805 manually transmits the wireless first event marker signal 260 by a time period of approximately thirty (30) minutes that results in the open 226 electrical relay 225 switched leg 756 moving to the normally closed 227 electrical relay 225 operational state resulting in the existing residential HVAC system 65 being reactivated 92 operationally as a reset for the residential HVAC safety control 50, see FIGS. 5 and 6.

Optionally for the residential HVAC safety control 50, wherein the radio frequency receiver 180 can further comprise an LED status light 825 to indicate whether the wireless first event marker signal 260 has been received and resulted in the control circuitry 245 outputting the second event marker signal 760 along the third electrical communication 761 resulting in the normally closed 227 electrical relay 225 switched leg 756 moving to the open operational state 226 resulting in the existing residential HVAC system 65 being deactivated 91, see FIGS. 5 and 6.

Another option for the residential HVAC safety control 50, is wherein the portable radio frequency transmitter 805 can further comprise an LED status light 830 to indicate whether the wireless first event marker signal 260 has been sent to the radio frequency receiver 180 and the control circuitry 245 outputting the second event marker signal 760 along the third electrical communication 761, resulting in the normally closed 227 electrical relay 225 switched leg 756 moving to the open operational state 226 resulting in the existing residential HVAC system 65 being deactivated 91, see FIGS. 5 and 6.

A further option for the residential HVAC safety control 50, is wherein the portable radio frequency transmitter 805 further comprises a covered button 820 to operationally facilitate the function 815 of being able to manually selectably wirelessly transmit the wireless first event marker signal 260 and to operationally minimize accidental button 845 activation, see in particular FIG. 3, plus FIGS. 5 and 6.

A method for installing a residential HVAC safety control 50 to effectuate a timely manually selectable portable and remote wireless shutdown of an existing residential HVAC system 65, the existing residential HVAC system 65 receives electrical power from an electrical utility 106, 108 with alternating current having the neutral wire leg 108 and the hot wire leg 106, the method for installing the residential HVAC safety control comprises the steps of firstly, providing the component elements of a power supply 190, a radio frequency receiver 180, control circuitry 180, a switching transistor 750, a normally closed electrical relay 225, and a portable radio frequency transmitter 805, all as previously described.

A next step of disconnecting the utility electrical power hot leg 106 from the existing residential HVAC system 65, see FIGS. 1 to 6.

A further step of connecting the power supply 190 input 195 to the first electrical communication 195 with the first input electrical power 185 being from the electrical utility with alternating current having a neutral wire leg 108 and a hot wire leg 106, see in particular FIG. 4.

A continuing step of connecting the normally closed 227 electrical relay 225 fourth electrical communication 756 input connection 787 to the electrical utility hot wire leg power feed 106, see in particular FIGS. 5 and 6.

Moving onward a step of connecting the normally closed 227 electrical relay 225 fourth electrical communication 756 output connection 788 to the electrical hot wire leg power feed 109 of the existing residential HVAC system 65, see in particular FIGS. 5 and 6.

Next a step of activating the portable radio frequency transmitter 805 to be operative to manually selectably wirelessly transmit the wireless first event marker signal 260 that is received by the radio frequency receiver 180 and the control circuitry 245 that in turn generates the second event marker signal 760 to result in the existing residential HVAC system 65 being deactivated 91, see in particular FIGS. 5 and 6.

Accordingly, the present invention of the residential HVAC safety control 50, has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A residential HVAC safety control to effectuate a manually selectable and remote wireless shutdown of an existing residential HVAC system, the existing residential HVAC system receives electrical power from an electrical utility with alternating current having a neutral wire leg and a hot wire leg, said residential HVAC safety control comprising:

a. a power supply that is in first electrical communication with a first input electrical power, wherein said power supply further includes a full wave bridge rectifier circuit with a wave smoothing capacitor and resistor for more consistent voltage and a first electrical buck convertor transformer providing a first electrical power output that converts the utility alternating current voltage to a first reduced voltage direct current, and a second electrical buck convertor transformer providing a second electrical power output that converts the utility alternating current voltage to a second reduced voltage direct current;

b. a radio frequency receiver that receives said second electrical power output from said power supply;

c. control circuitry that receives input electrical power from said second reduced voltage direct current through a second electrical communication, said control circuitry is in a ready state to monitor for a wireless first event marker signal along a seventh electrical communication, said control circuitry outputting a second event marker signal along a third electrical communication;

d. a switching transistor having a base connection, a collector connection, and an emitter connection, said base connection to receive said second event marker signal and when said second event marker signal is received said collector connection and said emitter connection are placed from a switched transistor open electrical communication state to a switching transistor closed electrical communication state to facilitate electrical communication from said collector connection to said emitter connection;

e. a normally closed electrical relay that receives input electrical power from said first reduced voltage direct current being a positive leg only to a primary terminal of said normally closed electrical relay, said normally closed electrical relay is also in electrical communication to said switching transistor collector connection through a secondary terminal on said normally closed electrical relay, said normally closed electrical relay switched leg is disposed in a fourth electrical communication between the electrical power from the electrical utility hot wire leg defined as going from an input connection to an output connection of said fourth electrical communication, said electrical relay connecting a normally closed electrical relay hot wire input connection and the existing residential HVAC system through a switched hot wire leg defined as a normally closed electrical power from the electrical utility, causing said normally closed electrical relay to allow said fourth electrical communication from said input to said output connections to be the electrical utility hot wire leg electrical power to the existing residential HVAC system, with the electrical utility neutral leg being in a fifth electrical communication between the electrical utility and the neutral leg power feed of the existing residential HVAC system, causing the existing residential HVAC system to be in a fully functional operational state when said normally closed electrical relay is in an un-activated operational state such that said normally closed electrical relay is in a closed state, and when said normally closed electrical relay is in an activated operational open state, opens said fourth electrical communication from the hot leg from the electrical utility to the electrical utility hot wire leg electrical power feed to the existing residential HVAC system, said normally closed electrical relay is energized into said activated operational open state through a negative ground of said first reduced voltage direct current being in a sixth electrical communication therethrough said collector connection to said emitter connection, causing said normally closed electrical relay switched leg to move to an open operational state causing the existing residential HVAC system to be deactivated; and f. a portable radio frequency transmitter that receives input electrical power from a battery, said portable radio frequency transmitter is operative to manually transmit said wireless first event marker signal that is received by said radio frequency receiver and said control circuitry in turn generates said second event marker signal, said radio frequency receiver control circuitry terminates said second event marker signal after said portable radio frequency transmitter manually transmits said wireless first event marker signal for a time period of approximately thirty (30) minutes that causes said open electrical relay switched leg to move to said normally closed electrical relay operational state causing the existing residential HVAC system to be reactivated operationally as a reset for said residential HVAC safety control.

2. A residential HVAC safety control according to claim 1 wherein said radio frequency receiver further comprises an LED status light to indicate whether said wireless first event marker signal has been received and causes said control circuitry to output said second event marker signal along said third electrical communication causing said normally closed electrical relay switched leg to move to said open operational state causing the existing residential HVAC system to be deactivated.

3. A residential HVAC safety control according to claim 1 wherein said portable radio frequency transmitter further comprises an LED status light to indicate whether said wireless first event marker signal has been sent to said radio frequency receiver and said control circuitry outputting said second event marker signal along said third electrical communication, causing said normally closed electrical relay switched leg to move to said open operational state causing the existing residential HVAC system to be deactivated.

4. A residential HVAC safety control according to claim 1 wherein said portable radio frequency transmitter further comprises a covered button to operationally facilitate said function of manually transmitting said wireless first event marker signal and to operationally minimize accidental button activation.

5. A method for installing a residential HVAC safety control to effectuate a manually selectable and remote wireless shutdown of an existing residential HVAC system, the existing residential HVAC system receives electrical power from an electrical utility with alternating current having a neutral wire leg and a hot wire leg, said method for installing said residential HVAC safety control comprises the steps of:

a. providing a power supply that is in a first electrical communication with a first input electrical power, wherein said power supply further includes a full wave bridge rectifier circuit with a wave smoothing capacitor and resistor for more consistent voltage and a first electrical buck convertor transformer providing a first electrical power output that converts the utility alternating current voltage to a first reduced voltage direct current, and a second electrical buck convertor transformer providing a second electrical power output that converts the utility alternating current voltage to a second reduced voltage direct current;

b. providing a radio frequency receiver that receives said second electrical power output from said power supply;

c. providing control circuitry that receives input electrical power from said second reduced voltage direct current through a second electrical communication, said control circuitry is in a ready state to monitor for a wireless first event marker signal along a seventh electrical communication, said control circuitry outputting a second event marker signal along a third electrical communication;

d. providing a switching transistor having a base connection, a collector connection, and an emitter connection, said base connection to receive said second event marker signal and when said second event marker signal is received said collector connection and said emitter connection are placed from a switched transistor open electrical communication state to a switching transistor closed electrical communication state to facilitate electrical communication from said collector connection to said emitter connection;

e. providing a normally closed electrical relay that receives input electrical power from said first reduced voltage direct current being a positive leg only to a primary terminal of said normally closed electrical relay, said normally closed electrical relay is also in electrical communication to said switching transistor collector connection through a secondary terminal on said normally closed electrical relay, said normally closed electrical relay switched leg is disposed in a fourth electrical communication between the electrical power from the electrical utility hot wire leg defined as going from an input connection to an output connection of said fourth electrical communication, said electrical relay connecting a normally closed electrical relay hot wire input connection and the existing residential HVAC system through a switched hot wire leg defined as a normally closed electrical power from the electrical utility causing said normally closed electrical relay to allow said fourth electrical communication from said input to said output connections to be the electrical utility hot wire leg electrical power to the existing residential HVAC system, with the electrical utility neutral leg being in a fifth electrical communication between the electrical utility and the neutral leg power feed of the existing residential HVAC system, causing the existing residential HVAC system to be in a fully functional operational state when said normally closed electrical relay is in an un-activated operational state such that said normally closed electrical relay is in a closed state, and when said normally closed electrical relay is in an activated operational open state, opens said fourth electrical communication from the hot leg from the electrical utility to the electrical utility hot wire leg electrical power feed to the existing residential HVAC system, said normally closed electrical relay is energized into said activated operational open state through a negative ground of said first reduced voltage direct current being in a sixth electrical communication therethrough said collector connection to said emitter connection, causing said normally closed electrical relay switched leg to move to an open operational state causing the existing residential HVAC system to be deactivated; and f. providing a portable radio frequency transmitter that receives input electrical power from a battery, said portable radio frequency transmitter is operative to manually transmit said wireless first event marker signal that is received by said radio frequency receiver and said control circuitry in turn generates said second event marker signal, said radio frequency receiver control circuitry terminates said second event marker signal after said portable radio frequency transmitter manually transmits said wireless first event marker signal for a time period of approximately thirty (30) minutes that causes said open electrical relay switched leg-moving to move to said normally closed electrical relay operational state causing the existing residential HVAC system to being reactivated operationally as a reset for said residential HVAC safety control;

g. disconnecting the utility electrical power hot leg from the existing residential HVAC system;

h. connecting said power supply input to said first electrical communication with said first input electrical power being from the electrical utility with alternating current having a neutral wire leg and a hot wire leg;

i. connecting said normally closed electrical relay fourth electrical communication input connection to the electrical utility hot wire leg power feed;

j. connecting said normally closed electrical relay fourth electrical communication output connection to the electrical hot wire leg power feed of the existing residential HVAC system; and k. activating said portable radio frequency transmitter to be operative to manually transmit said wireless first event marker signal that is received by said radio frequency receiver and said control circuitry in turn generates said second event marker signal causing the existing residential HVAC system being deactivated.

* * * * *